United States Patent [19]

Pelda et al.

[11] 4,402,594

[45] Sep. 6, 1983

[54] FIRE EXTINGUISHING DEVICE FOR ELECTROPHOTOCOPIER

[75] Inventors: Frederick J. Pelda, White Plains, N.Y.; Eugene A. Wirth, Huntington, Conn.

[73] Assignee: Pitney Bowes Inc., Stamford, Conn.

[21] Appl. No.: 360,871

[22] Filed: Mar. 22, 1982

Related U.S. Application Data

[62] Division of Ser. No. 108,607, Dec. 31, 1979, Pat. No. 4,341,945.

[51] Int. Cl.[3] ..... G03G 15/20

[52] U.S. Cl. ..... 355/3 FU; 219/216; 355/133

[58] Field of Search ..... 355/3 R, 3 FU, 133, 355/14 FU; 169/60, 61, 70; 432/46, 49, 60; 219/216

[56] References Cited

U.S. PATENT DOCUMENTS

| | | | |
|---|---|---|---|
| 3,706,491 | 12/1972 | Furman et al. | 355/3 FU X |
| 3,778,222 | 12/1973 | Suzuki | 355/3 FU X |
| 3,979,161 | 9/1976 | Kremer et al. | 355/133 |
| 4,101,266 | 7/1978 | Ishikawa | 355/3 FU X |
| 4,168,903 | 9/1979 | Tolmie | 355/3 FU X |

*Primary Examiner*—Fred L. Braun

*Attorney, Agent, or Firm*—Lawrence E. Sklar; William D. Soltow, Jr.; Albert W. Scribner

[57] ABSTRACT

A fire extinguishing device for use with a heat fusing apparatus in an electrophotocopying machine, including a roller movably mounted above a copy paper conveyor associated with and located downstream of the heat fusing apparatus, a moving device for moving the roller into rolling contact with the conveyor when an abnormality is detected in the fusing apparatus during the copying operation, and a device for maintaining the roller out of rolling contact with the conveyor when no abnormality in the fusing apparatus is detected during the copying operation.

6 Claims, 6 Drawing Figures

FIRE EXTINGUISHING DEVICE FOR ELECTROPHOTOCOPIER

This is a division of application Ser. No. 108,607, filed Dec. 31, 1979, now U.S. Pat. No. 4,341,945.

BACKGROUND OF THE INVENTION

The instant invention relates to electrophotocopying machines, and more particularly to a device for extinguishing burning copy paper before it exits the copier's heat fusing mechanism.

In the field of electrophotographic copying particularly in that area characterized as plain paper copying, a photoconductor comprising a photoconductive composition coated on a rigid or flexible substrate is uniformly electrostatically charged in the dark and then exposed by being illuminated in an image pattern in accordance with graphic material on an original document. The photoconductor becomes discharged in the areas exposed to the illumination but retains its electrostatic charge in the areas not exposed to illumination which areas correspond to the graphic material on the original document. An electrostatically attractable developing material is applied to the photoconductor, the developing material adhering to the charged areas of the photoconductor material but not to the uncharged areas, thereby resulting in a visible image of developing material which is then transferred to plain paper or other suitable substrate to become the ultimate copy. Any residual developing material remaining on the photoconductor is cleaned and the photoconductor is reused in the above manner for subsequent copies. Since the developing material is heat fusible, application of heat to the sheet of paper causes the developing material to melt and be fused into the paper so as to be permanently affixed thereto.

Since most developing materials used in plain paper electrophotographic copying are formed of thermoplastic materials which melt at fairly high temperature levels, it is typical practice to utilize a fusing device having a radiant energy source of heat which generates an extremely high temperature atmosphere in the area through which the sheet of paper passes. This extremely high temperature is necessary in view of the fact that the fusing of the developing material must take place while the sheet of paper is moving through the fuser and a given segment of developing material is exposed to the source of heat for only a brief period of time. Since the temperature of the atmosphere immediately adjacent the paper exceeds the ignition temperature of the paper, it is apparent that the paper will catch fire as a result of almost spontaneous combustion if the piece of paper should stop moving in the fuser. Potentially, this situation could be very dangerous since other parts of the copying machine could catch fire from the burning paper which is only partly enclosed within the fuser. Also, if a portion of the burning paper has already exited from the fuser, previous copies deposited in a copy paper collection tray could catch fire and possibly cause personal injury to the operator of the copying machine. Thus, it is readily apparent that a very serious problem exists with respect to utilization of this type of fuser in an electrophotographic copying machine in the event of any failure in the copying machine which results in an interruption of the movement of the copy sheet through the fuser.

The above described problem has long been recognized, not only in the electrophotographic copying field, but even before that in the motion picture field. U.S. Pat. No. 1,845,840 discloses a restricted passageway through which motion picture film is drawn while passing through a projector so that if the film should catch fire for any reason while passing through the projector, the fire will be choked for lack of oxygen within the confined space of the constricted area to prevent the fire from exiting from this space.

In the electrophotographic coping field, several approaches have been taken in the prior art to satisfactorily cope with the problem of fire in the fusing devices of various types of copying machines. For example, in U.S. Pat. No. 3,357,401 an air jet detector is utilized to detect the presence of a copy sheet exiting from the fusing device. In the event that the copy sheet jams in the fusing device and fails to exit therefrom, an electric circuit responsive to the combined effects of the air jet and a timer operates to energize a fire extinguishing system.

In U.S. Pat. No. 3,705,289 a bridge circuit is utilized to detect temperature in the fuser above a predetermined limit to automatically terminate the operation of the fuser while allowing a ventilator to continue to operate. The bridge circuit continuously monitors the fuser to assure that the temperature remains within predetermined limits.

In U.S. Pat. No. 3,804,516 a similar type of electric bridge circuit is utilized to detect the presence of a fire in the fuser by measuring any variation in the temperature resulting from a burning sheet in order to generate an output signal to warn the operator of the existence of the fire in the machine.

In U.S. Pat. No. 3,748,086 a mechanical device is utilized to measure the velocity of the copy paper traveling through the fuser and any variation from a predetermined velocity is electronically sensed to activate appropriate controls to de-energize the source of heat in the fuser to prevent the copy sheet from catching fire.

In U.S. Pat. No. 3,778,222 a fusing apparatus includes a means for sensing the presence of fire in response to which suitable mechanical means operate to enclose the passgeway of the copy sheet through the fusing device thereby preventing spread of the fire from the fusing device.

In U.S. Pat. No. 3,979,161, a fusing apparatus in an electrophotographic copier includes a fire extinguishing snuffer device located somewhat downstream from the heat radiating portion of the fuser so that in the event of combustion of the copy sheet the flames will be extinguished by the copy sheet passing between closely spaced plates of the snuffing device.

In U.S. Pat. No. 4,101,266 a heat shield plate movable to close the fixing apparatus is controlled by a mechanism having first and second solenoids so that the heat shield plate shuts the fixing apparatus only when a driving power for the copying machine is stopped or an abnormality is detected in a fixing step during the copying operation.

In U.S. Pat. No. 4,118,178 the fusing apparatus includes a secondary driving means to maintain operation of the copy paper conveying system so that the conveying system does not stop with the sheet of paper still adjacent the source of heat, which would allow the sheet of paper to catch fire.

Many of the approaches taken to prevent or extinguish fires involve the use of snuffing plates. However, snuffer plates are closely spaced to each other, so that the melted toner on the copy sheets passing therethrough frequently comes into contact with one of the snuffer plates. Accordingly, tacky toner tends to build up on one of the snuffer plates, which in turn tends to stick to subsequent copy sheets passing therethrough. Once a copy sheet becomes stuck between the snuffer plates, it is likely to be ignited by the heat in the fusing apparatus. The instant invention is therefore designed to provide a snuffing device which overcomes the problems associated with the snuffer plates, and also is capable of simultaneously extinguishing a fire on a copy paper and conveying the copy paper away from the fusing apparatus. None of the prior art snuffing devices possesses the three foregoing characteristics which clearly are necessary for a reliable and effective snuffer in an electrophotocopier.

SUMMARY OF THE INVENTION

Accordingly, the instant invention provides a fire extinguishing device for use with a heat fusing apparatus in an electrophotocopying machine, comprising a roller movably mounted above a copy paper conveyor associated with and located downstream of the heat fusing apparatus, means for moving the roller into rolling contact with the conveyor when an abnormality is detected in the fusing apparatus during the copying operation, and means for maintaining the roller out of rolling contact with the conveyor when no abnormality in the fusing apparatus is detected during the copying operation.

DETAILED DESCRIPTION

Figure 4:
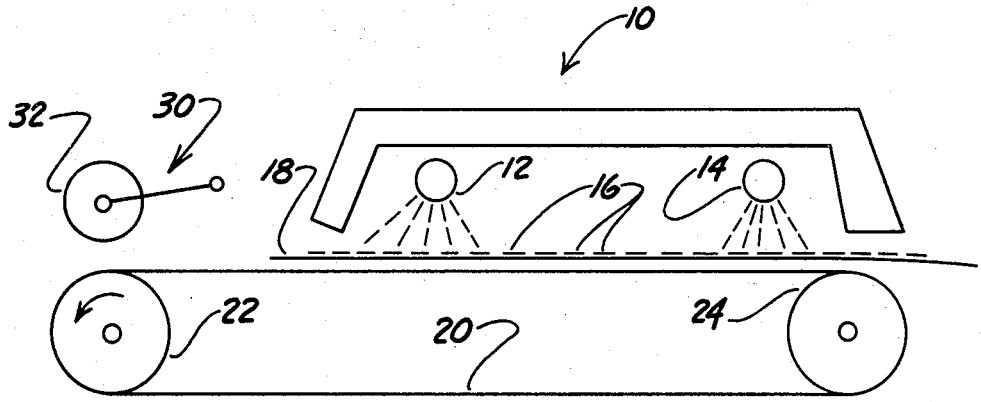
FIG. 4 is a schematic, side elevational view of the fusing section and fire extinguishing device when copy paper is passing normally through the fusing section.
Figure 5:
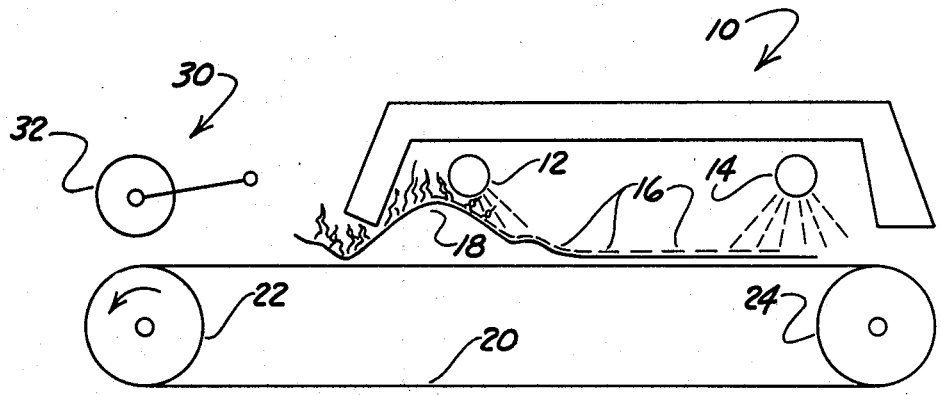
FIG. 5 is similar to FIG. 4 except that the copy paper has ignited in the fusing section.
Figure 6:
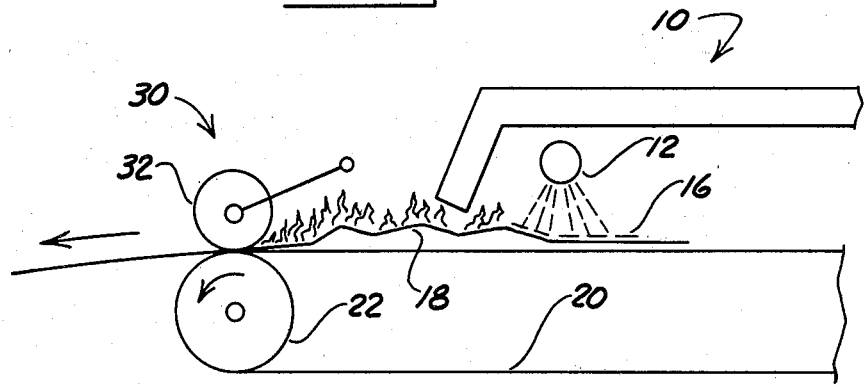
FIG. 6 is substantially similar to FIG. 5 except that the fire extinguishing device is lowered into its operative position to extinguish the fire.

In describing the preferred embodiment of the instant invention, reference is made to the drawings, wherein there is seen a fusing section generally designated 10 of an electrophotocopying machine (not shown) having a pair of radiant heater lamps 12 and 14 mounted in a side frame 52 and an auxiliary side frame 53 for heat fusing toner particles 16 (see FIGS. 4–6) to a copy sheet 18 passing therebeneath on a conveyor belt 20. As best seen in FIG. 4–6, the conveyor belt 20 is rotatably supported by a pair of rollers 22 and 24, the roller 22 being journalled in a sprocket wheel 26 and driven by a chain 28 mounted on the wheel 26.

Figure 1:
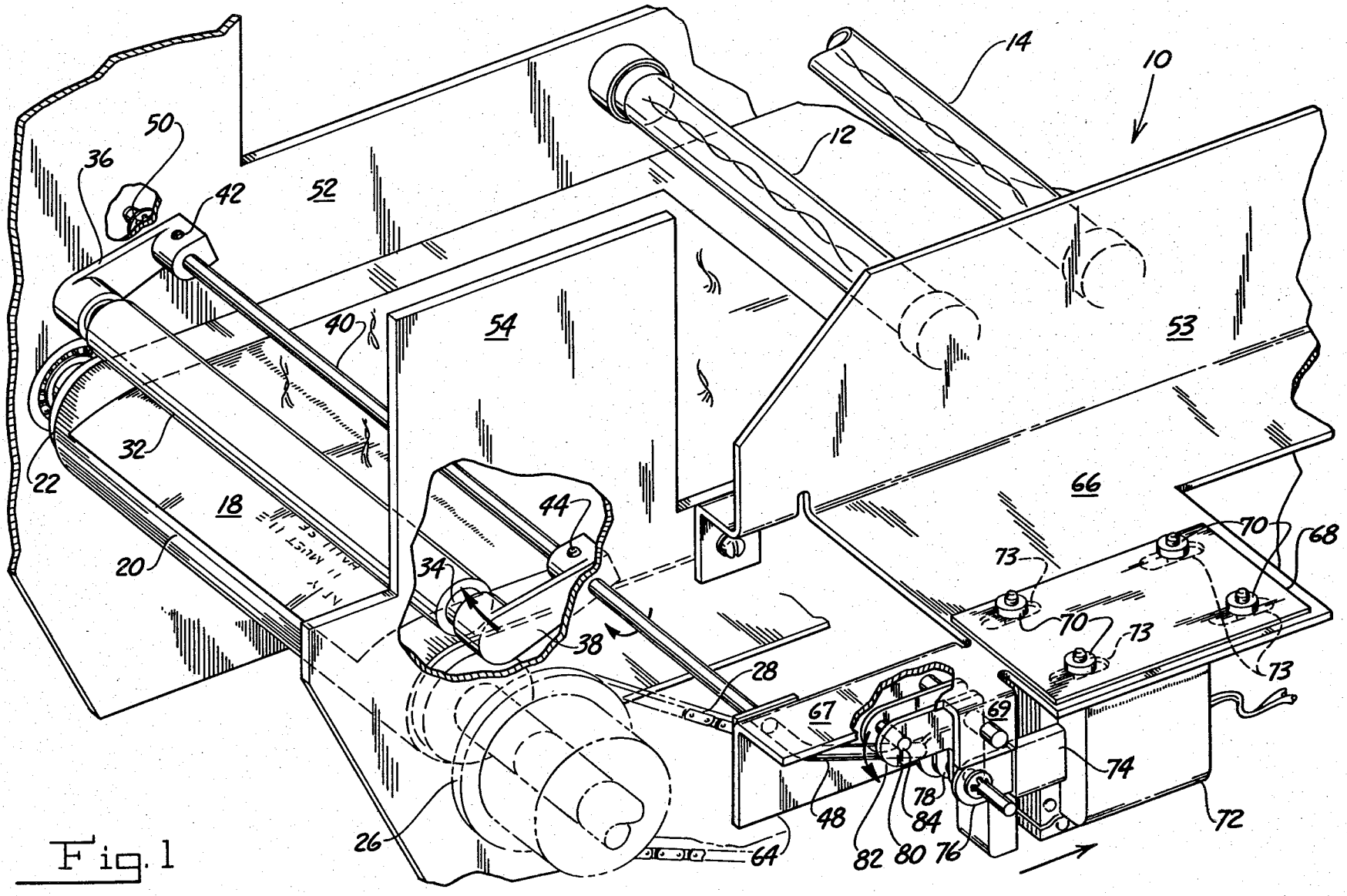
FIG. 1 is a perspective view of a fusing section of an electrophotocopier and a fire extinguishing device according to the instant invention.
Figure 2:
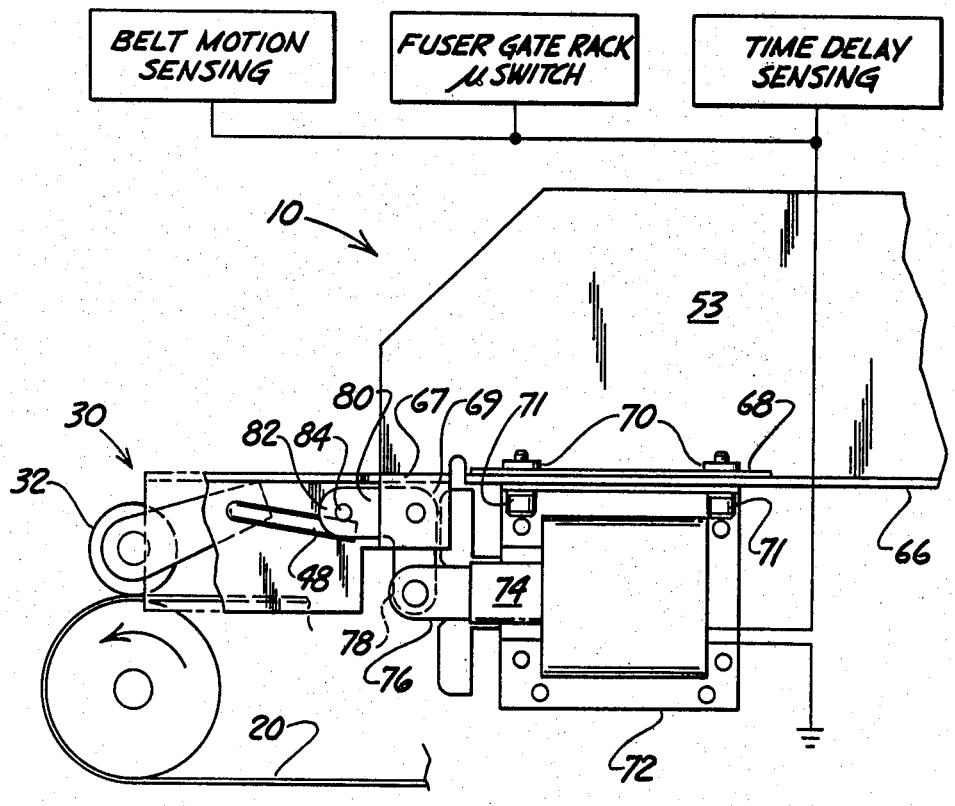
FIG. 2 is a side elevational view of the fusing section and fire extinguishing device shown in FIG. 1, with the fire extinguishing device being shown in its operative position.
Figure 3:
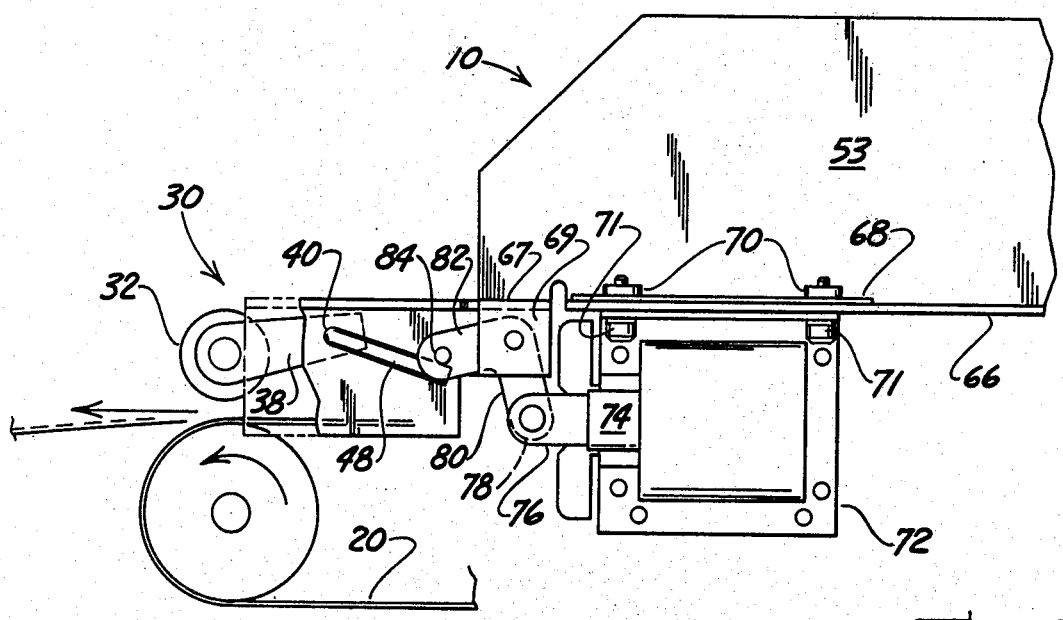
FIG. 3 is the same as FIG. 2 except that the fire extinguishing device is shown in its inoperative position.

As best seen in FIGS. 2 and 3, the fire extinguishing device, generally designated 30, comprises a silicone rubber roller 32 fixed to a shaft 34 which is rotatably mounted at its ends to a pair of brackets 36 and 38. The brackets 36 and 38 are fixedly mounted on a crankshaft 40 by means of a pair of set screws 42 and 44. The crankshaft 40 terminates at one end in a lever arm 48 and at the other end with a clip 50. The crankshaft 40 is pivotably supported in side frames 52 and 54 and a lateral side wall 64.

A flange 66 extends horizontally outwardly from the auxiliary side frame 53 and includes an extension 67 from which the lateral side wall 64 depends on one side and from which a rectangular section 69 extends vertically downwardly on the other side.

A housing 72 for a solenoid 74 is adjustably secured to the flange 66 by means of a bracket 68, four PEM nuts 70, four bolts 71 and four longitudinally extending slots 73 in the flange 66 (to permit proper alignment during final assembly of parts).

The plunger 76 of the solenoid 74 is pivotably connected to the end of an arm 78 of a right-angled bracket 80. The right-angled bracket 80 is pivotally mounted on the vertically extending section 69. Secured at the end of the other arm 82 of the right-angled bracket 80 is a post 84 which is situated on top of the lever arm 48 of the crankshaft 40.

When the solenoid 74 is not energized, the silicone rubber roller 32 is in contact and idles with the conveyor belt 20 in what may be called an operative position for extinguishing fires, as seen in FIG. 2. The weight of the roller 32 is sufficient to maintain the roller 32 contiguous with the belt 20, and movement of the belt 20 causes the roller 32 to rotate. In order to lift the roller 32 up and away from the belt 20, the solenoid 74 must be energized. When the solenoid is in fact energized, the solenoid plunger 76 moves to the right (see FIG. 3), thereby rotating the right-angled bracket 80 counter-clockwise. The counter-clockwise movement of the bracket 80 causes the post 84 to move downward against the lever arm 48 of the crankshaft 40. The crankshaft 40 is thereby caused to rotate clockwise, which in turn causes the brackets 36 and 38 to pivot upward and away from the conveyor belt 20. Since the silicone rubber roller 32 is rotatably mounted to the brackets 36 and 38, the roller 32 is also caused to pivot upward and away from the conveyor belt 20.

During the warmup period of the electrophotocopier when the radiant heater lamps 12 and 14 are continuously on and the conveyor belt 20 is moving, the solenoid 74 is not energized and the roller 32 is in rolling contact with the conveyor belt 20. Should a jammed sheet of copy paper have been left in the electrophotocopier and ignited during this period, and should the paper free itself and begin to exit the copier, the roller 32 would extinguish the flames.

When the print cycle for the copier is energized, the solenoid 74 is energized to thereby lift the roller 32 off the conveyor belt 20, thereby allowing copy sheets to exit. This lifting procedure is necessary to prevent offsetting of toner particles onto the copy sheet.

Referring now to the three circuits schematically represented in FIG. 2, the TIME DELAY SENSING circuit includes sensors (not shown) located at the entrance and exit ends of the fuser 10 tied into a timer circuit which is set into motion when the paper feed clutch (not shown) is energized. If the copy paper does not clear the sensors in a predetermined time, the heater lamps 12 and 14 are turned off and the solenoid 74 is de-energized, causing the roller 32 to drop, by gravity, into position on the conveyor belt 20 to extinguish any potential fire exiting the fuser section 10.

The solenoid 74 is also de-energized if the conveyor belt 20 stops moving by means of a BELT MOTION SENSING circuit. If a jam occurs in the fusing section 10, a FUSER GATE RACK μSWITCH (not shown) is actuated mechanically and the solenoid 74 is de-energized.

Should the solenoid 74 fail for any reason, the roller 32 will drop and eventually cause off-setting on the copy sheets, resulting in a call for service. Should the roller 32 freeze in its bearings, it would result in a fuser jam also resulting in a service call. Thus, the fire extinguishing device 30 is essentially fail-safe.

Although the roller 32 has been described as formed from a silicone rubber, the roller 32 may be formed from any heat resistant material, including metals, although resilient materials are preferred.

What is claimed is:

1. An electrophotocopying machine, comprising:

a heat fusing apparatus;

a copy paper conveyor associated with and located downstream of the heat fusing apparatus; and a fire extinguishing device operatively associated with said heat fusing apparatus, said fire extinguishing device including a heat resistant roller movably mounted above and in contact with the copy paper conveyor, means for lifting said roller out of contact with said conveyor when the print cycle for said electrophotocopying machine is energized, means for maintaining said roller out of contact with said conveyor during the copying operation, and means for moving said roller into rolling contact with said conveyor when a copy paper fails to clear the fusing apparatus within a predetermined period of time, whereby any fire of the copy paper is extinguished.

2. The electrophotocopying machine of claim 1, wherein the roller is resilient.

3. The electrophotocopying machine of claim 1, wherein the roller is formed from a silicone rubber.

4. The electrophotocopying machine of claim 1, wherein the means for moving the roller into rolling contact with said conveyor consists of the weight of the roller.

5. The electrophotocopying machine of claim 1, wherein the means for maintaining said roller out of rolling contact with said conveyor comprises a solenoid operatively connected to said roller.

6. The electrophotocopying machine of claim 5, additionally comprising electrical sensing circuits operatively connected to said solenoid for detecting abnormalities in the fusing apparatus during the copying operation.

* * * * *